United States Patent [19]

Kishi et al.

[11] Patent Number: 5,058,213

[45] Date of Patent: Oct. 22, 1991

[54] RAW SEWAGE DRYING APPARATUS

[75] Inventors: Mitsuhiro Kishi; Toyohiko Sunaoka, both of Ashikaga, Japan

[73] Assignee: Kabushiki Kaisha Hikoma Seisakusho, Tochigi, Japan

[21] Appl. No.: 609,378

[22] Filed: Nov. 5, 1990

Related U.S. Application Data

[62] Division of Ser. No. 351,028, May 12, 1989, Pat. No. 4,999,930.

[30] Foreign Application Priority Data

| | | | |
|---|---|---|---|
| May 21, 1988 | [JP] | Japan | 63-124150 |
| Jul. 12, 1988 | [JP] | Japan | 63-172852 |
| Jul. 29, 1988 | [JP] | Japan | 63-190857 |
| Jul. 29, 1988 | [JP] | Japan | 63-190858 |
| Nov. 19, 1988 | [JP] | Japan | 63-292789 |

[51] Int. Cl.[5] ..... A47K 11/02

[52] U.S. Cl. ..... 4/111.1; 34/95

[58] Field of Search ..... 4/111.1, 111.5, 111.6, 4/449; 34/95, 179

[56] References Cited

U.S. PATENT DOCUMENTS

| | | | |
|---|---|---|---|
| 2,279,578 | 4/1942 | Martin | 4/111.3 |
| 4,521,304 | 6/1985 | Yount | 4/111.1 X |

*Primary Examiner*—Henry A. Bennet

*Attorney, Agent, or Firm*—Flynn, Thiel, Boutell & Tanis

[57] ABSTRACT

A raw sewage drying apparatus, such as for a portable toilet. The apparatus has an outer casing with an opening in an upper portion thereof, and an outer cover for covering the opening. An inner casing made of a heat resistent material is housed in the outer casing. The inner casing has an opening in an upper portion thereof, and an inner cover for covering the opening. A heating device heats the inner casing. A rotatable drive shaft unit is provided in the inner casing, and a plurality of blades are fixed to the drive shaft unit for stirring the raw sewage stored in the inner casing. A plurality of heating balls are contained in the inner casing for heating the raw sewage.

3 Claims, 15 Drawing Sheets

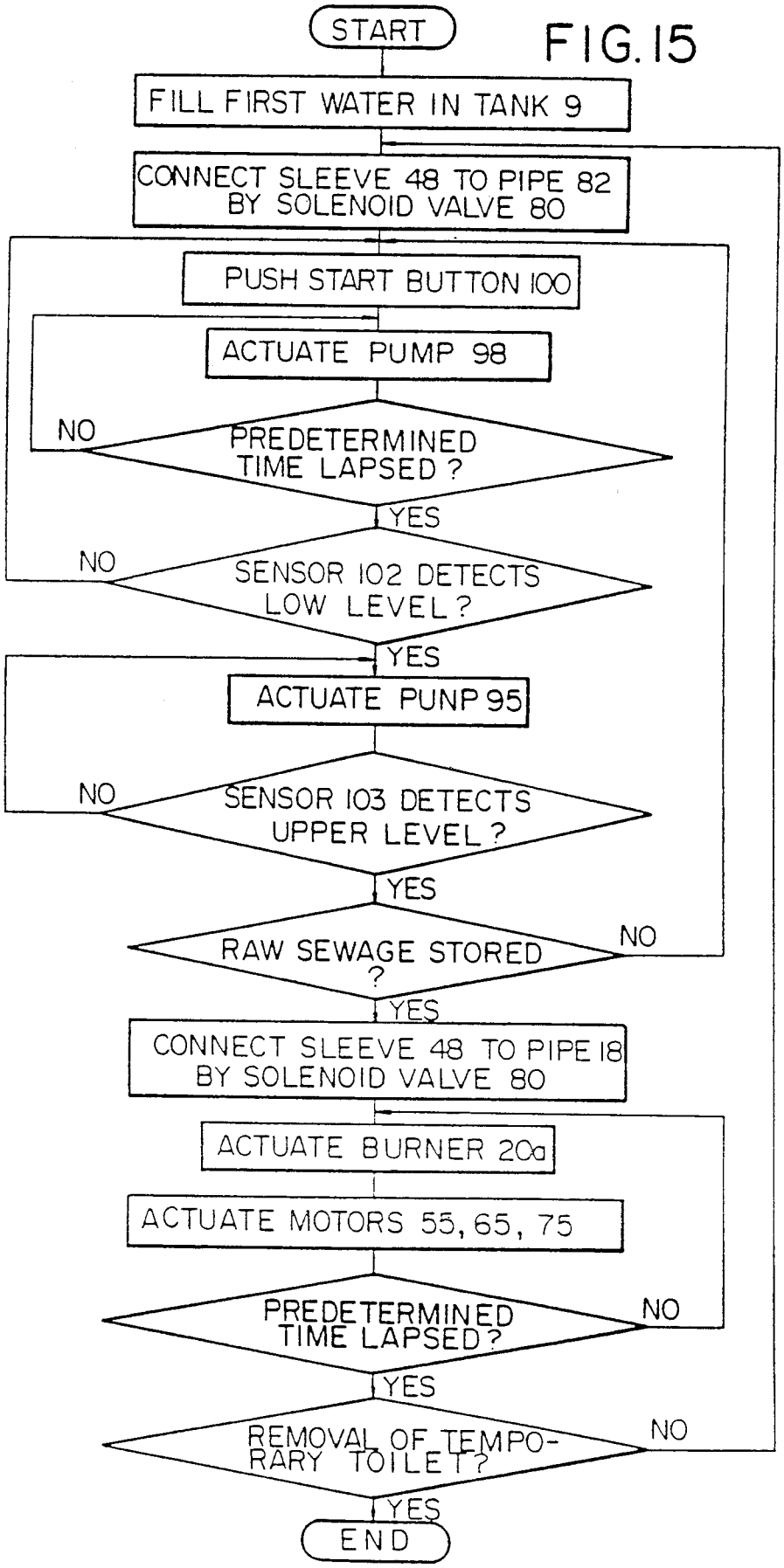
START
FIG. 15
FILL FIRST WATER IN TANK 9
CONNECT SLEEVE 48 TO PIPE 82 BY SOLENOID VALVE 80
PUSH START BUTTON 100
ACTUATE PUMP 98
PREDETERMINED TIME LAPSED ?
NO
YES
SENSOR 102 DETECTS LOW LEVEL ?
NO
YES
ACTUATE PUNP 95
SENSOR 103 DETECTS UPPER LEVEL ?
NO
YES
RAW SEWAGE STORED ?
NO
YES
CONNECT SLEEVE 48 TO PIPE 18 BY SOLENOID VALVE 80
ACTUATE BURNER 20a
ACTUATE MOTORS 55, 65, 75
PREDETERMINED TIME LAPSED ?
NO
YES
REMOVAL OF TEMPO-RARY TOILET ?
NO
YES
END

RAW SEWAGE DRYING APPARATUS

This is a division of Ser. No. 07/351,028, filed May 12, 1989, now U.S. Pat. No. 4,999,930.

FIELD OF THE INVENTION

The present invention relates to a raw sewage drying apparatus for disposing of raw sewage, which apparatus can be utilized outdoors, in a transportation means such as a vessel or train, or in a tunnel through which a tank truck used for collecting raw sewage (hereafter referred to simply as a vacuum truck) can not go.

BACKGROUND OF THE INVENTION

The raw sewage discharged from the human body is typically discharged to a sewage system by use of a flush toilet in an ordinary house or is discharged into a river after being temporarily stored in a holding tank and purified therein. However, at events such as festivals, athletic events, fairs and the like, temporary toilet facilities must be provided.

Employed conventionally are movable temporary toilets, most of which have a tank for accommodating raw sewage therein. However, the temporary toilet has a problem in that the raw sewage stored in the tank is sucked into a vacuum truck for collection, which is laborious and time consuming.

Transportation vehicles such as trains, buses, vessels, etc. which operate over long distances are provided with an exclusive tank for storing and holding the discharged raw sewage. The raw sewage in this tank is subjected to a deodorizing treatment by chemicals, and thereafter collected by a vacuum truck.

In facilities of the above type, the raw sewage is stored in the state as discharged from the human body, so that disposal of the raw sewage is unhygienic. Also, a long period of use of the tank creates sewage residue on the tank which causes a bad smell which is disliked by an operator. Thus, such temporary sewage facilities are not preferable in modern times.

In an attempt to improve on the above, there have been proposed several hygienic proposal methods. In one method, for example, chemicals are introduced into the tank where the raw sewage is stored to thereby prevent the bad smell and effect a sterilization. This is mainly employed in the transportation industry such as on trains. This method, however, cannot be used for a long period of time because the chemicals become diluted, and costs are high.

In another method the raw sewage is stored in a bag made of vinyl to prevent the diffusion of the bad smell. This method however requires a vinyl bag of large size and involves high cost for disposal thereof, and is troublesome in separating the raw sewage from the bag.

In still another method the discharged raw sewage is directly dried by use of heat from a burner, etc. Since the primary component of raw sewage is liquid, it requires a large amount of heat energy to remove the liquid and it takes a long time to effect disposal of the raw sewage.

SUMMARY OF THE INVENTION

It is a first object of the present invention to provide a raw sewage drying apparatus capable of being employed outdoors or on vehicles so that the raw sewage discharged from the human body is dried quickly in a short period of time and prevents generation of a bad smell while the solid component which is not evaporated is simultaneously crushed and disposed of as a powder to thereby provide a hygienic raw sewage drying apparatus.

It is a second object of the invention to provide a drying apparatus capable of reducing loss of energy by providing a pipe for supplying air into a coil wound around the tank while the same pipe is preheated so that the preheated air is supplied into the tank.

It is a third object of the invention to provide a raw sewage drying apparatus capable of increasing thermal efficiency by collecting part of the heat from a burner and blowing the collected part of the heat as hot air toward a space defined between an inner casing and an outer casing.

It is a fourth object of the invention to provide a raw sewage drying apparatus capable of directly heating with high termal efficiency the raw sewage stored in the inner casing by hot air without heating the raw sewage indirectly from the outside of the inner casing to expedite the oxidation of the raw sewage.

It is a fifth object of the invention to provide a raw sewage drying apparatus which can be employed in a temporary toilet and which can be cleaned by water in a manner similar to a residential flush toilet.

To achieve the above first object, a first embodiment of the invention comprises an outer casing, an inner casing housed in the outer casing and made of a heat-resistance material for storing the raw sewage therein, a heating means to heat the inner casing from the outside surface thereof, a stirring means provided with a plurality of blades for stirring the raw sewage stored in the inner casing, and a plurality of heating balls housed in the inner casing.

To achieve the second object, the raw sewage drying apparatus according to a second embodiment comprises a heat exchanger pipe wound around a heater which is wound around the outer lower portion of an inner casing, and a reheating pipe wound around the outer upper portion of the inner casing so as to contact the peripheral surface of the heater, in addition to all of the components of the drying apparatus according to the first embodiment.

To achieve the third object, the raw sewage drying apparatus comprises a burner for jetting hot air toward the space defined between the inner casing and the outer casing, in addition to the main components of the first and second embodiments.

To achieve the fourth object, the raw sewage drying apparatus comprises a heating unit connected to a blower or a hot air nozzle, in addition to the main components of the above-described embodiments.

To achieve the fifth object, the raw sewage drying apparatus comprises a water tank outside the raw sewage drying apparatus and a controller for controlling the water tank and the jetting operation of the raw sewage drying apparatus The above and other objects, features and advantages of the present invention will become apparent from the following description taken in conjunction with the accompanying drawings

BRIEF DESCRIPTION OF THE DRAWINGS

FIG. 15 is a flow chart explaining the operation of the sixth embodiment.

DETAILED DESCRIPTION

First Embodiment (FIGS. 1-4)

A raw sewage drying apparatus according to a first embodiment of the invention will be described with references to FIGS. 1-4. A temporary toilet 1 capable of being moved about by a truck or the like will be described first.

Figure 1:
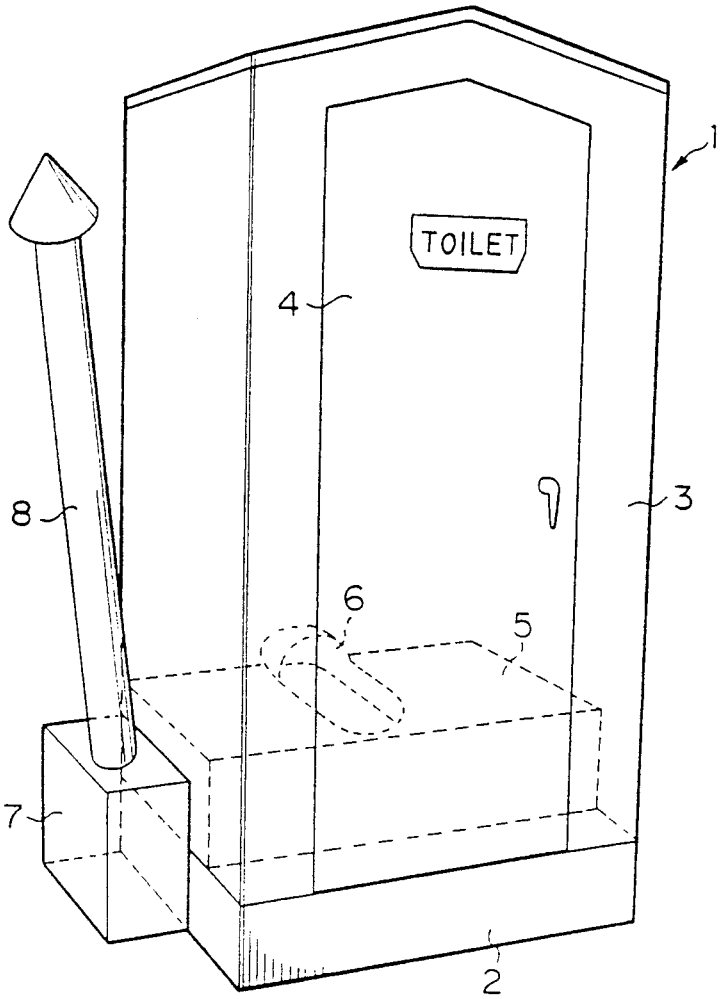
FIG. 1 is a perspective view of a temporary (i.e. portable) toilet employing a raw sewage drying apparatus according to first through seventh embodiments of the present invention.

In FIG. 1, the temporary toilet 1 is made of reinforced synthetic resin plastic and has a box shape. The toilet 1 has a base 2 which can be supported on a surface of the earth and which has a roofed house 3 fixed thereto. A door 4 is attached to a front portion of the house 3. The temporary toilet 1 has inside thereof a drying apparatus 5 which is fixed to an upper portion of the base 2. A stool 6 is fixed to an upper portion of the drying apparatus 5 for receiving the raw sewage. The base 2 has a dust collection unit 7 at the side thereof which is provided with a discharge pipe 8 at the upper portion thereof for discharging liquid (i.e. vapor) from the raw sewage to the atmosphere.

Figure 2:
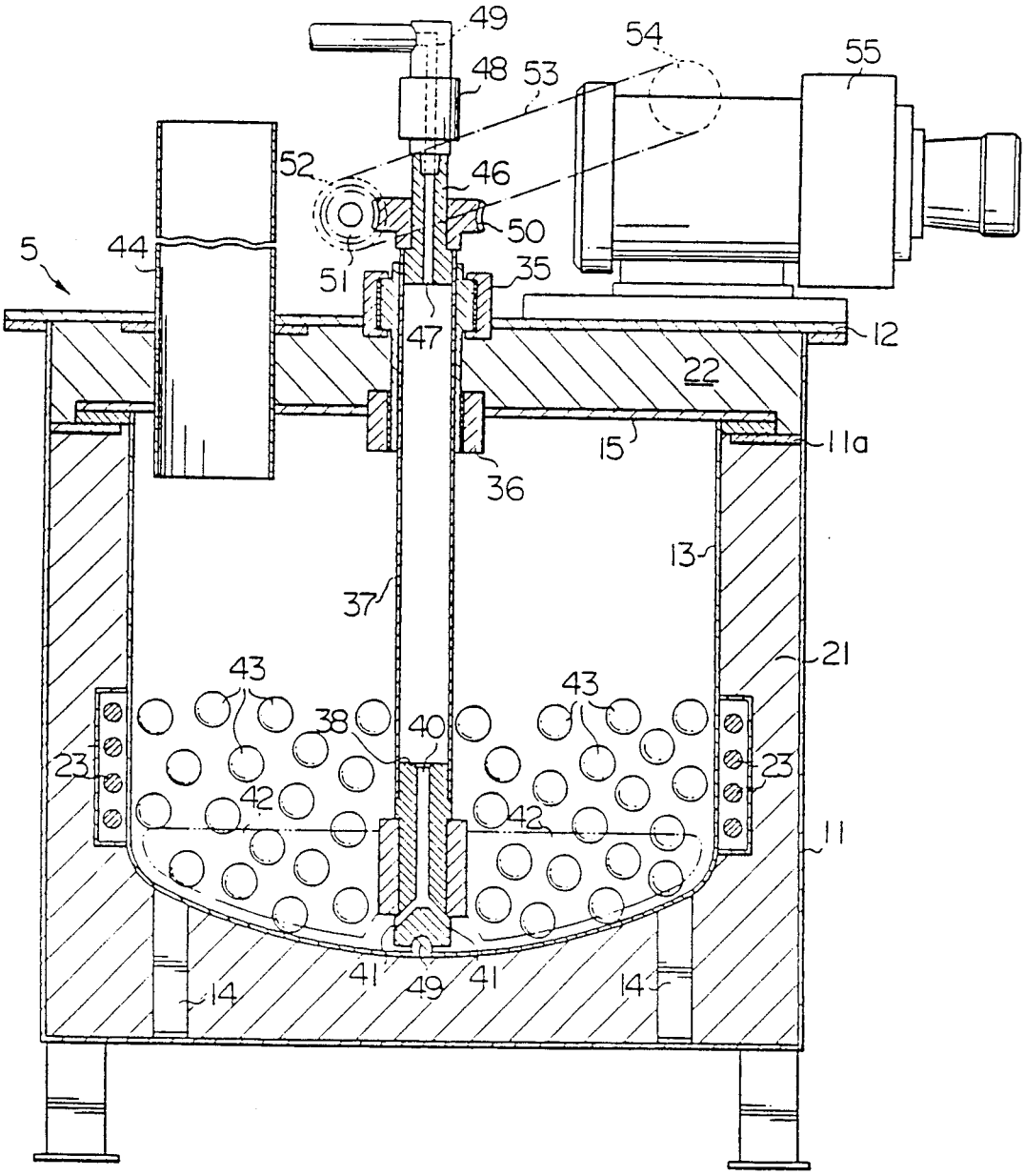
FIG. 2 is a cross sectional elevational view of the raw sewage drying apparatus according to a first embodiment of the invention.
Figure 4:
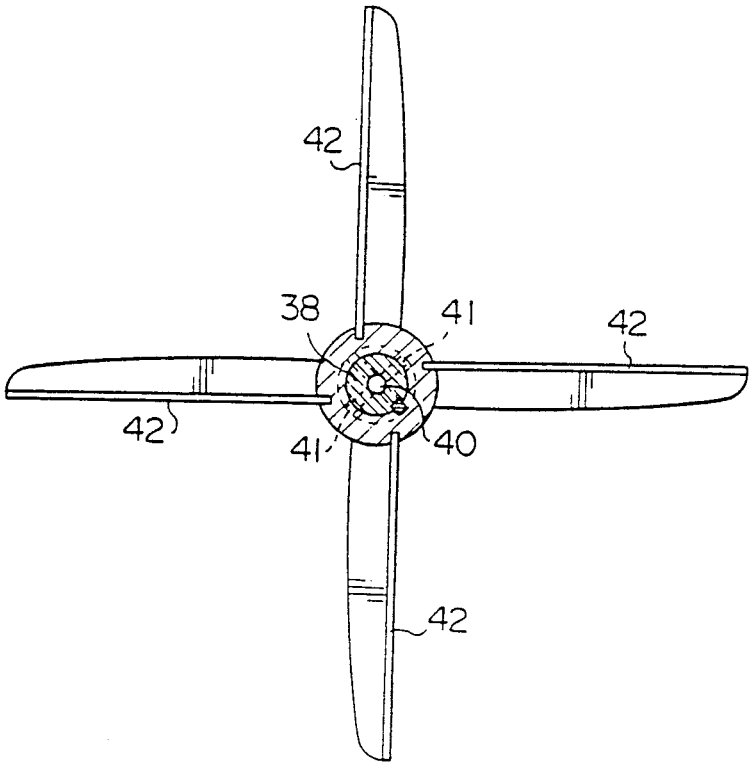
FIG. 4 is a plan view of the stirring blades according to the first through seventh embodiments of the present invention.

Referring to FIG. 2, the drying apparatus 5 comprises an outer casing 11 made of thin steel plate of a cubic shape open at the upper portion thereof, an outer cover 12 fixed to a top peripheral surface of the outer casing 11, an inner casing 13 having a semi-spherical curved lower portion and an open upper portion, an inner cover 15 fixed to a top peripheral surface of the inner casing 13, a heat insulating material 22 made of glass wool etc. interposed between the outer cover 12 and the inner cover 15, a heat insulating material 21 of glass wool etc. interposed in the space 10 between the outer casing 11 and the inner casing 13, legs 14 fixed to the bottom of casing 13 and interposed between the lower portion of the inner casing 13 and the bottom of the outer casing 11 for supporting the inner casing 13, a projection 11*a* projecting from the inner upper portion of the outer casing 11 for supporting the upper end of the inner casing 13, a heater 23 (an electric heating coil) exteriorly wound around the lower portion of the inner casing 13 for heating the inner casing 13, bearings 35-36 respectively fixed to the central portions of the outer cover 12 and inner cover 15, a hollow drive pipe 37 rotatably mounted coaxially on the bearings 35-36 and penetrating vertically inside the outer casing 11 and the inner casing 13 substantially along the central vertical axis thereof, a metal shaft piece 38 fixed to the lower portion of the drive pipe 37 and having a concave recess in the lower end thereof for receiving therein a projection 49 protruding upwardly from the bottom of the inner casing 13 for rotatably supporting the lower end of the drive pipe 37, a vent passage 40 extending axially of the member 38 and being branched at the lower portion thereof to define communication holes 41 for communicating with the inside space of the inner casing 13, four radially-projecting stirring blades 42 fixed to the lower metal piece 38 at 90° angular intervals as shown in FIG. 4 and positioned close to the curved bottom of the inner casing 13, an upper metal shaft piece 46 coaxially fixed to the upper portion of the drive pipe 37 and projecting upwardly above the outer cover 12, vent passage 47 vertically penetrating the piece 46, a worm gear 50 fixed to the upper shaft piece 46, a worm 51 engaged with the worm gear 50, a sprocket wheel 52 fixed to the worm 51, a sprocket wheel 54 fixed to a motor 55 mounted on the outer cover 12, a chain 53 entrained around the sprocket wheels 52 and 54 for transmitting the output of the motor to the worm 51, a plurality of heating balls 43 (such as metal balls) contained in the inner casing 13, and an introduction pipe 44 vertically penetrating the covers 12 and 15 for communicating between the stool 6 and the inner casing 13 so that the raw sewage is introduced from the stool 6 to the inner casing 13.

Figure 3:
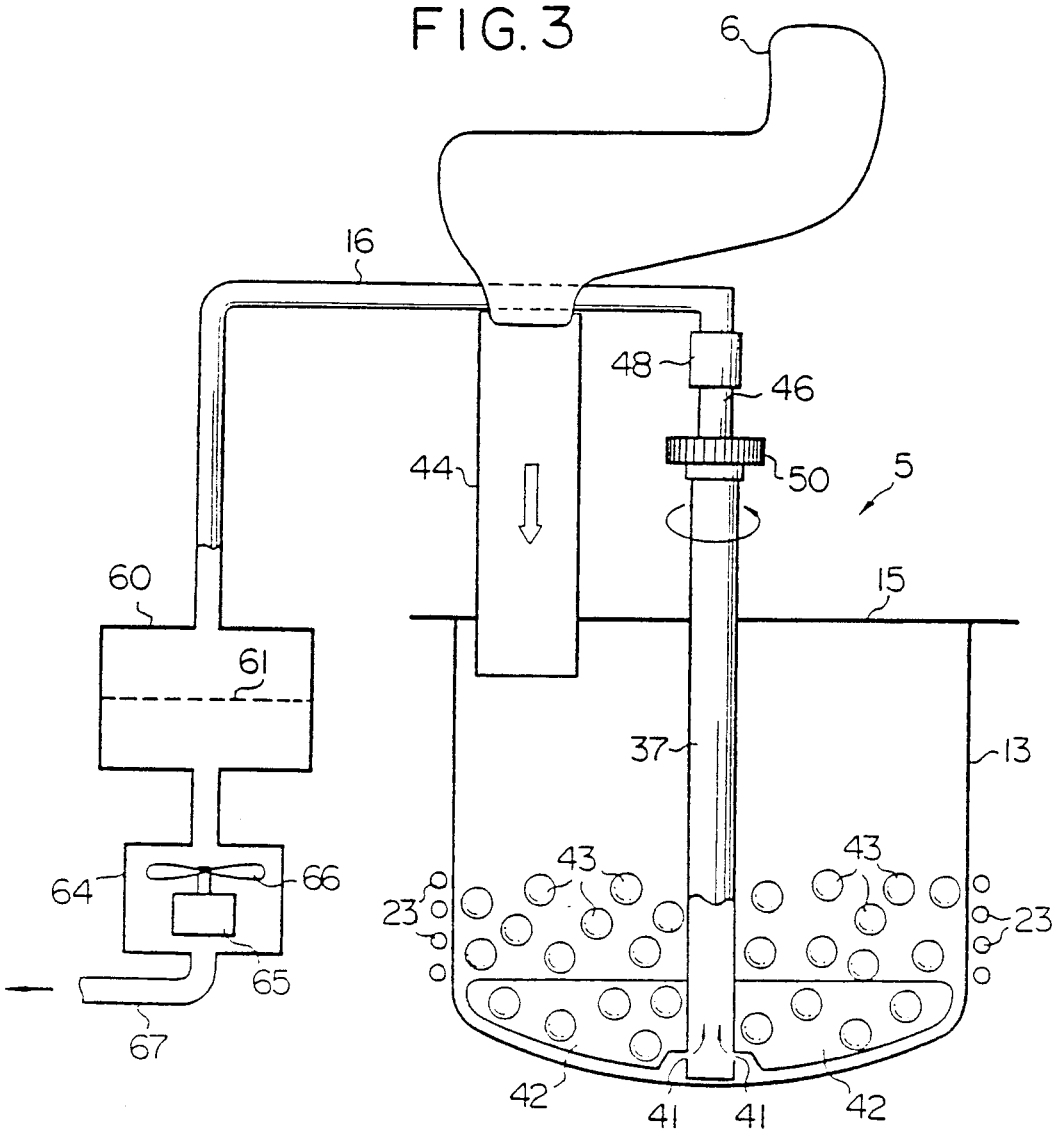
FIG. 3 is a view for explaining the connection between the raw sewage drying apparatus and a dust collection unit according to the first embodiment.

The connection of the raw sewage drying apparatus to the dust collection unit 7 is illustrated in FIG. 3. A sleeve 48 fixed to the upper metal piece 46 is connected to a duct 16 which communicates with a dust collector 60 via a vent passage 49 (FIG. 2) communicating with the vent passage 47. The dust collector 60 has inside thereof a filter 61 of a metal mesh, such as platinum, having a catalyzing function and connected to a discharging unit 64 having a motor 65 and a fan or blower 66 therein. The blower 66 is connected to the discharge pipe 8 via a duct 67.

The operation of the raw sewage drying apparatus according to the embodiment of FIGS. 1-4 will be described herewith.

The user enters the temporary toilet 1 and discharges raw sewage into the stool 6. The discharged raw sewage falls via the introduction pipe 44 into the inner casing 13 and is temporarily collected therein. When the discharged raw sewage is stored in the inner casing 13, the heater 23 is energized to heat the inner casing 13 and at the same time the motor 55 is actuated to rotate the drive pipe 37 via the worm 51 and worm gear 50. The heat generated by the heater 23 is transmitted to the heating balls 43 as well as to the whole of the inner casing 13. The raw sewage stored in the inner casing 13 is heated by the heat from the inner casing 13 and the heat from the heating balls 43 so that the liquid component of the sewage starts to evaporate.

Inasmuch as the drive pipe 37 is rotated by the motor 55, the stirring blades 42 rotate horizontally at the bottom of the inner casing 13 to thereby stir the raw sewage and the heating balls 43 at the same time, whereby the newly collected and stored raw sewage is mixed together so as to become the same temperature as a whole. The heat of the heating balls 43 is transmitted to the raw sewage from the surface of the heating balls 43 to expedite the temperature increase of the raw sewage since the raw sewage contacts the surfaces of the heating balls 43.

At this time, when the fan 66 is rotated, the air from outside passes through the dust collector 60, the vents 49 and 47, and the drive pipe 37, whereby the outside air is introduced into the inner casing 13 through the vent 40 and communication holes 41. Hence, the oxygen of the air is mixed with the heated raw sewage to expedite the oxidation and thereby expedite the drying operation.

With the energization of the heater 23 for a predetermined time period for heating the inner casing 13 while the stirring blades 42 are rotated to stir the heating balls 43 and the raw sewage, most of the liquid among the raw sewage is evaporated and the solid material such as fibers and effete matter remain in the inner casing 13. The solid material is crushed by the rotation of the stirring blades 42 and contact with the heating balls 43 and forms minute powders which collect in the bottom of the inner casing 13. Accordingly, the heating balls 43 and the minute powders of solid material of the raw sewage remained within the inner casing 13 after the liquid component of the raw sewage is evaporated.

Upon completion of the drying operation, the heater 23 and motor 55 are de-energized. Then the cleaning of the inner casing 13 is started.

First, the motor 65 is reversely rotated to reversely rotate the fan 66 so that the air in the dust collector 60 is discharged outside via the duct 67. Thus, the air in the inner casing 13 flows through the communication holes 41, the vent 40 and the drive pipe 37 and is sucked into the dust collector 60 via the vents 47 and 49 and the duct 16. Accompanied by the suction of the air, the solid materials (as minute powders) residual in the inner casing 13 is sucked with the air and collected by the filter 61, while only the air is discharged from the duct 67 to the atmosphere. With this reverse actuation of the discharging unit 64, the inner casing 13 is cleaned so that the solid material in the form of powders are removed from the inner casing 13. The raw sewage drying apparatus 5 is thus ready to again receive raw sewage. Hence, it is not necessary to destroy the inner casing 13 each time upon completion of the raw sewage drying operation. The residual solid material can be discharged while the inner casing 13 is kept intact.

With the repetition of the operation, the liquid component of the collected raw sewage is evaporated and diffused to the atmosphere. The remaining solid material is dried and processed into minute powders and sucked into the filter 61 by the discharging unit 64, whereby the inner casing 13 is automatically cleaned and ready for next disposal of raw sewage.

With the arrangement of the raw sewage drying apparatus according to the FIGS. 1–4 embodiment, it is possible to evaporate the liquid component at a temporary facility or on vehicles such as automobiles or vessels in a highly hygienic manner. Furthermore, since the solid material can be formed into minute powders and sucked and discharged together with the air in the inner casing, automatic cleaning of the casing can be carried out. As a result, it is possible to use the temporary toilet of this invention in a hygienic manner for a long period of time without requiring maintenance thereof.

Figure 5:
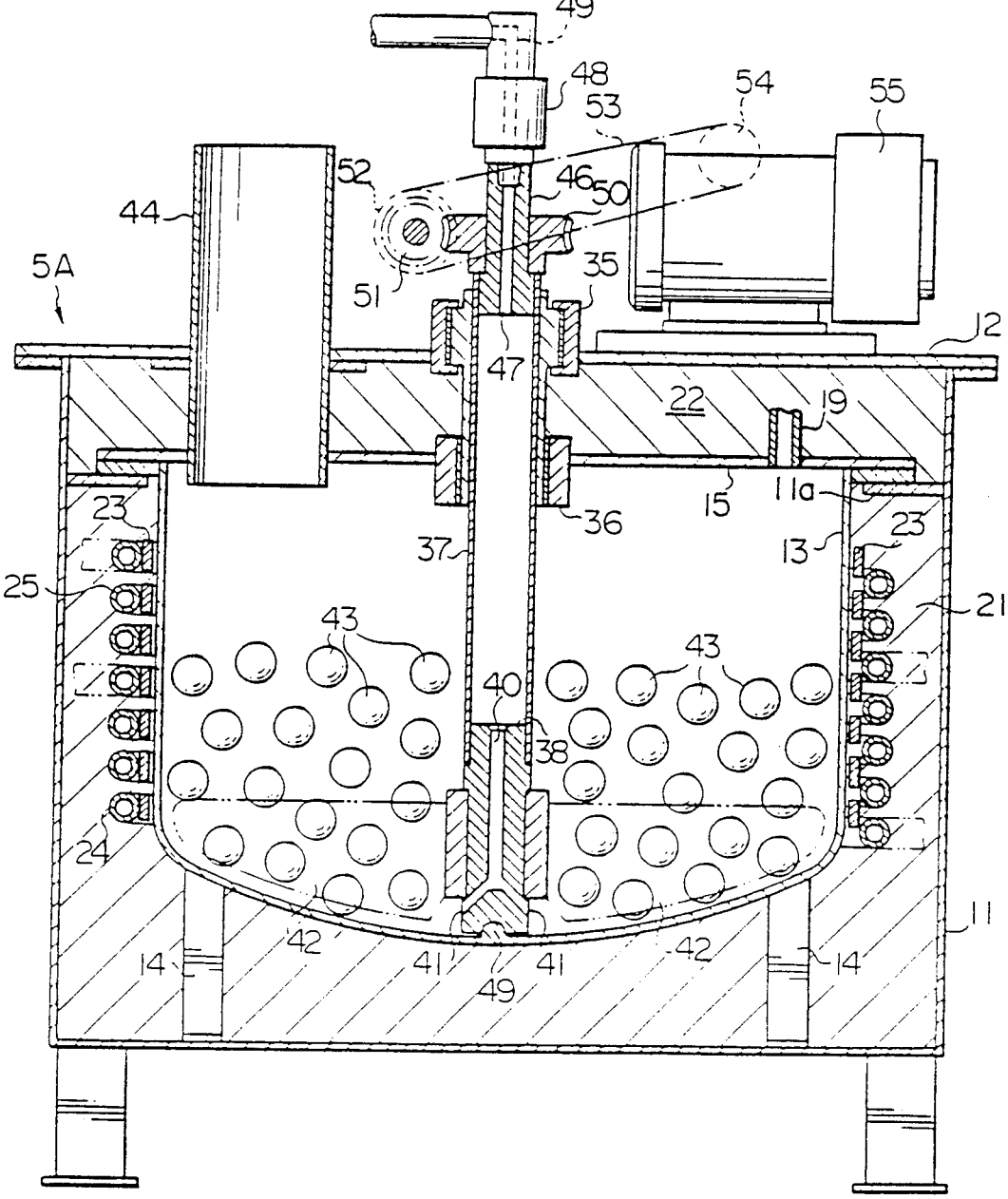
FIG. 5 is a vertical cross sectional view of the drying apparatus according to a second embodiment.
Figure 6:
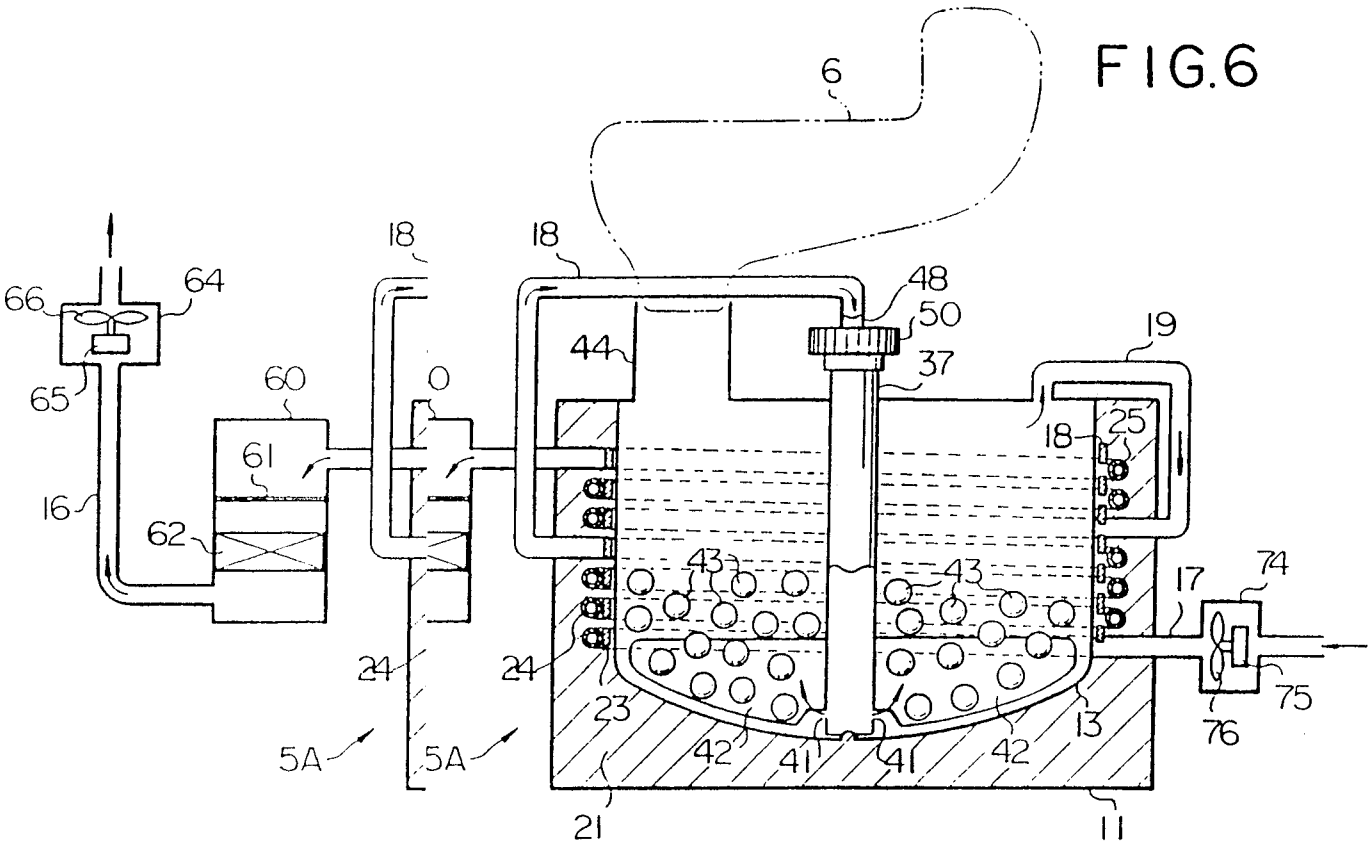
FIG. 6 is a view for explaining the connection between the drying apparatus and the dust collection unit according to the second embodiment.

Second Embodiment (FIGS. 5 and 6)

A raw sewage drying apparatus according to a second embodiment of the invention will be described with reference to FIGS. 5 and 6. In this embodiment, as well as other embodiments described hereinafter, corresponding components of the drying apparatus of the first embodiment are included and are denoted by the same reference numerals so that additional explanation of these components is omitted.

The raw sewage drying apparatus 5A of this second embodiment includes a heat exchanger pipe 24 wound around the heater 23 at the outer lower portion of the inner casing 13, and a re-heating pipe 25 wound around the heater 23 at the outer upper portion of the inner casing 13. As illustrated in FIG. 6, the heat exchanger pipe 24 is connected at one end thereof via a pipe 17 to a blower unit 74 having a motor 75 and a fan 76 therein, and is connected at the other end thereof to a connection pipe 18 extending from the outer casing 11 and fixed to the sleeve 48. The re-heating pipe 25 is connected at one end thereof to a suction pipe 19 communicating with the interior of the inner casing 13 and extending from the inner casing 13 to the circumference of the outer casing 11, and is connected at the other end thereof to the dust collector 60 having the filter 61 and catalyst 62.

In operation, the motor 75 of the blower unit 74 is actuated to rotate the fan 76 so that air from the outside or the atmosphere is introduced into the heat exchanger 24. Since the heat exchanger 24 has plural coils wound around the heater 23, the heat exchanger 24 is heated by the heater 23 so that the air flowing inside the heat exchanger 24 is heated and transferred to the connection pipe 18. The hot air supplied from the connection pipe 18 is introduced into the drive pipe 37 via the vents 49 and 47. The hot air in the drive pipe 37 is discharged from the communication holes 41 via the vent 40 into the bottom of the inner casing 13. As a result, the hot air thus discharged toward the bottom of the inner casing 13 blows the raw sewage which is already heated by the heating balls 43, whereby the raw sewage is heated by the heating balls 43 and by the hot air to accelerate the drying operation.

Simultaneously, the motor 65 in the first blower unit 64 is actuated to rotate the fan 66 to thereby allow the air in the inner casing 13 to be drawn into the suction pipe 19. The air thus drawn into the suction pipe 19 is delivered to the pre-heating pipe 25. Since the air in the pre-heating pipe 25 is heated by the heater 23, the air including bad smells such as ammonia is re-heated at the time when the air passes therethrough and is delivered to the dust collector 60. Within the dust collector 60, impurities and gases in the air are removed first by the filter 61, then the air contacts the catalyst 62 whereby the oxidation is expedited and the component creating the bad smell is oxidized. As a result the bad smell is removed. Thereafter the air in the dust collector 60 passes through the discharge pipe 16 and is discharged to the atmosphere via the discharging blower unit 64. Although the discharged air includes the liquid component as vapor, it does not include the bad smell or the dust.

The heater 23 is energized for a predetermined period of time and the stirring blades 42 are rotated by the actuation of the motor 55 so that the raw sewage is subjected to the drying operation whereby the liquid component of the sewage, which is the majority of the sewage, is evaporated while leaving only a small amount of dried solid material as residue in the inner casing 13.

Upon completion of the disposal of all the raw sewage, the heater 23 is de-energized and all the motors 55, 65, 75 are stopped.

Figure 7:
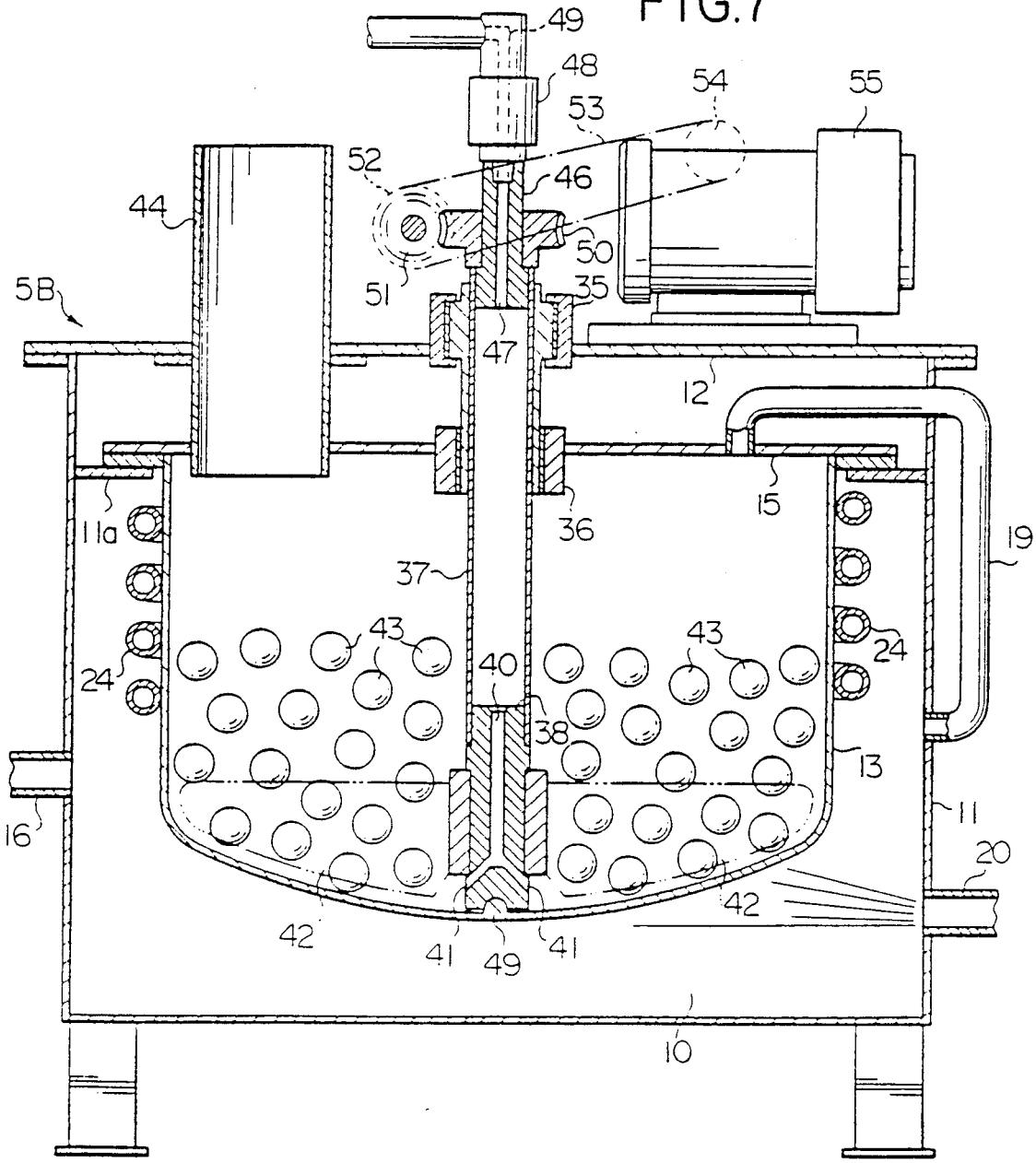
FIG. 7 is a vertical cross sectional view of the drying apparatus according to a third embodiment of the invention.
Figure 8:
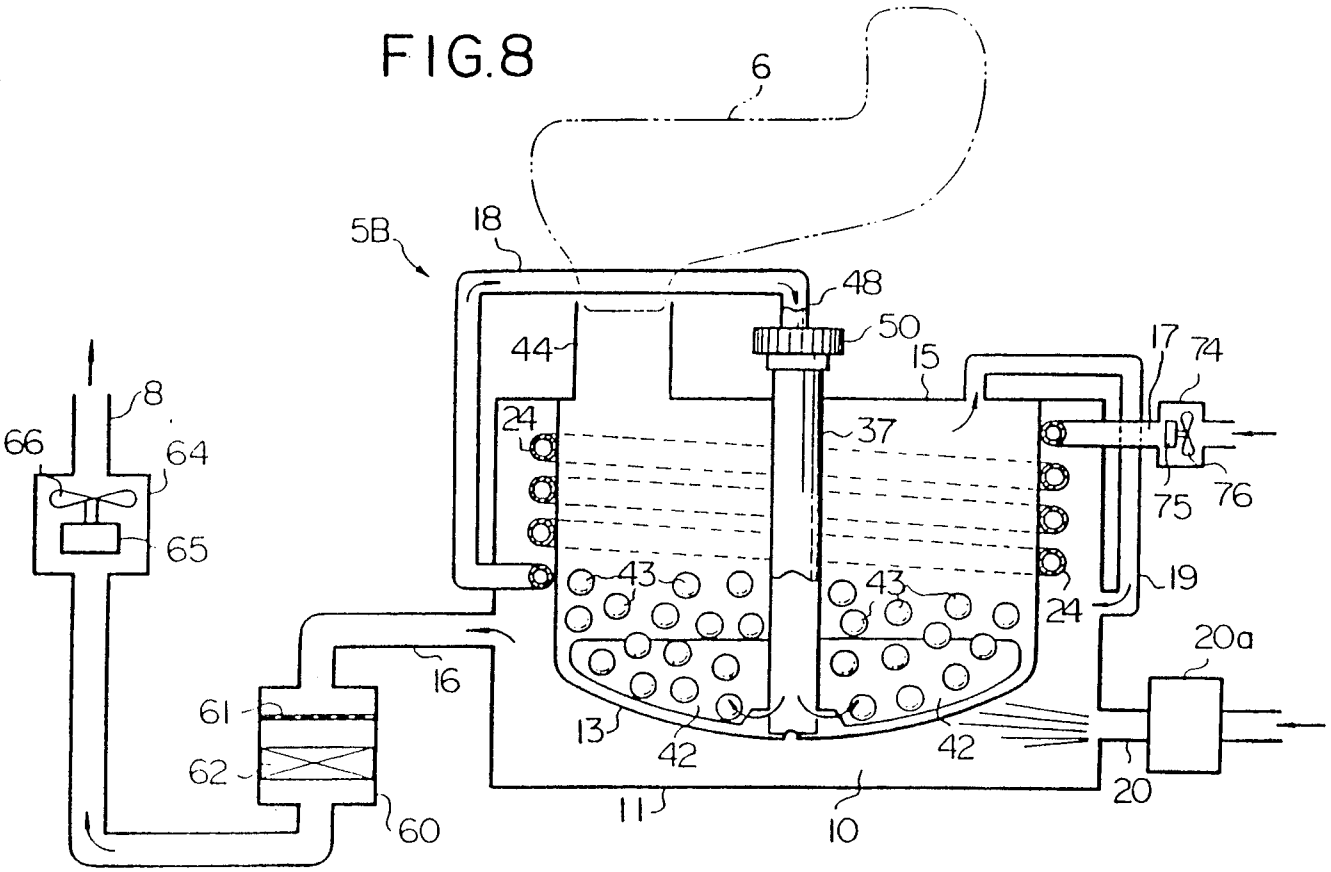
FIG. 8 is a view for explaining the connections between the drying apparatus and peripheral device according to the third embodiment.

Third Embodiment (FIGS. 7 and 8)

A raw sewage drying apparatus according to a third embodiment of the invention will be described with reference to FIGS. 7 and 8.

The raw sewage drying apparatus 5B of the third embodiment includes the heat exchanger pipe 24 wound directly around an outer surface of the inner casing 13, and a burner unit **20*a* provided outside the outer casing 11 and having a discharge pipe 20 connected to the outer casing 11 for communication with the open space 10** between the casings.

The inner casing 13 is supported solely by being suspended from the projection **11*a*, the latter being an annular flange projecting inwardly from the inner upper portion of the outer casing 11. The space or chamber 10 defined between the outside of the inner casing 13 and the inside of the outer casing 11** is open but is sealed from the outside.

The burner unit **20*a* is connected to one end of the burner pipe 20 for blowing hot air generated by combusting petroleum or gas into the space 10. A discharge pipe 16 connects to the outer lower portion of casing 11 opposite to the burner pipe 20. The heat exchanger pipe 24 made of a superior heat conductive material such as copper is wound directly around the outer circumference of the inner casing 13**.

The raw sewage drying apparatus 5B is connected to the dust collection unit 60, the air-supply blower unit 74, and the heater or burner unit **20*a* is illustrated in FIG. 8**.

The heat exchanger pipe 24 is connected at one end thereof through pipe 17 to the blower unit 74, and at the other end thereof to the connection pipe 18 which is connected to the sleeve 48. A return pipe 19 is provided at the inner cover 15 and has one end opened into the inner casing 13 and the other end opened into the space 10 at a location substantially in the middle of the outer casing.

In operation, when a predetermined amount of raw sewage is stored in the inner casing 13, the burner **20*a* is actuated to blow hot air from the burner pipe 20 into the space 10. Since the motors 65 and 75 are already actuated, the air within the space 10 is always drawn toward the diffusion pipe 8 via duct 16 and dust collector 60. Upon actuation of the motor 75, the air from the outside, namely from the atmosphere, flows into the heat exchanger pipe 24 and moves toward the sleeve 48. At the same time, since the air in the space 10 is drawn toward the diffusion pipe 8, as set forth above, the air in the inner casing 13 is sucked into the return pipe 19 and flows into the space 10, and is then discharged outside of the outer casing 11** together with the hot air.

As mentioned above, since the air combusted in the burner **20*a* is heated and is discharged into the space 10, the hot air heats the lower portion of the inner casing 13 as a whole to thereby heat the heating balls 43 within the inner casing 13. Hence, the raw sewage stored in the inner casing 13 is subjected to heating by both the heat from outside and inside the inner casing, namely from the whole of the inner casing 13 and from the heating balls 43**.

Upon actuation of the blower 74 to rotate the fan 76 to thereby allow the atmospheric air to circulate in the heat exchanger pipe 24, this air within pipe 24 is heated by the hot air within the space 10. This heated air then moves through connection pipe 18 and passes into the drive pipe 37, and then passes through the vent 40 and communication holes 41 and is blown into the bottom of the inner casing 13. Inasmuch as the outside air is already heated by the heat exchanger pipe 24 and increased in temperature, the blown air having such high temperature contacts the raw sewage for expediting the evaporation of the liquid component.

As explained in detail, the raw sewage stored in the inner casing 13 is subjected to the drying operation by the heat from the heat exchanger 24 and the hot air generated from the burner **20*a* as blown into the bottom space 10. The air including the moisture within the inner casing 13 passes into the return pipe 19 and flows into the space 10. Vapor evaporated from the inner casing 13 and the air contain therein urea and ammonia, these being components of the raw sewage which create a bad smell. Once the vapor and the air from casing 13 are introduced into the space 10 through the pipe 19, the air is heated to an extreme higher temperature due to the discharge from burner pipe 20, and is then discharged through the duct 16**.

With a series of operations, the raw sewage stored in the inner casing 13 is heated by the heat from the heat exchanger 24 and the heat from the burner **20*a* as well as the heating balls 43 capable of absorbing the heat and having a large surface area so that the liquid component of the raw sewage is rapidly evaporated while the small amount of minute solid component is collected by the filter 61**.

With the arrangement of the raw sewage drying apparatus 5B according to the third embodiment of the invention, the raw sewage can be disposed of in a highly hygienic manner and without leaving residual matter within the inner casing when compared with the conventional suction truck disposal method. Hence, the raw sewage drying apparatus of the third embodiment can be used in a place having no sewage disposal facility for a long period of time. Furthermore, since a part of the heat for heating the inner casing is collected by the hot air which is blown into the drying chamber, high thermal efficiency can be obtained to thereby shorten the time involved in the evaporation of the liquid component.

Figure 9:
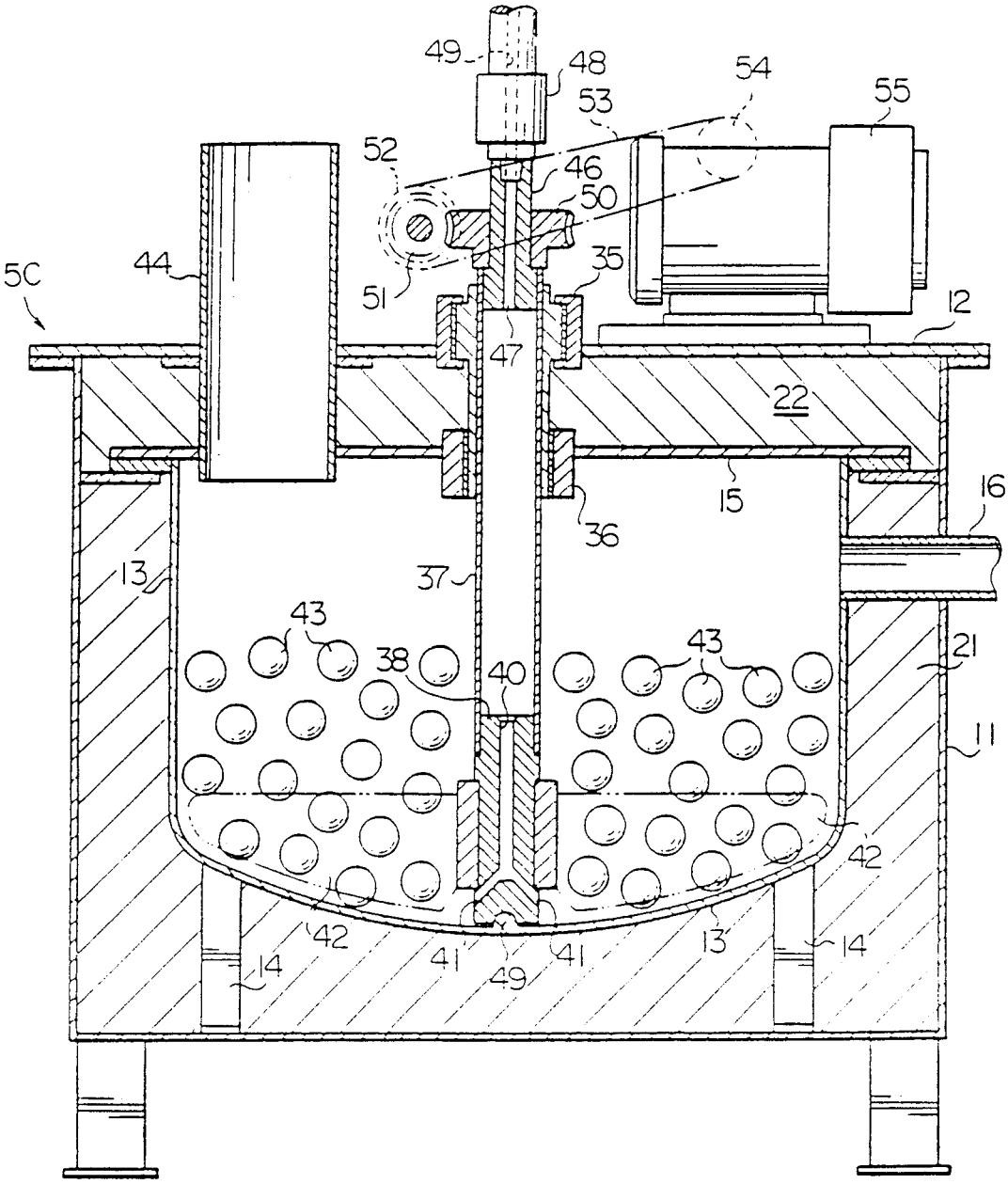
FIG. 9 is a vertical cross sectional view of the raw sewage drying apparatus according to a fourth embodiment of the invention.
Figure 10:
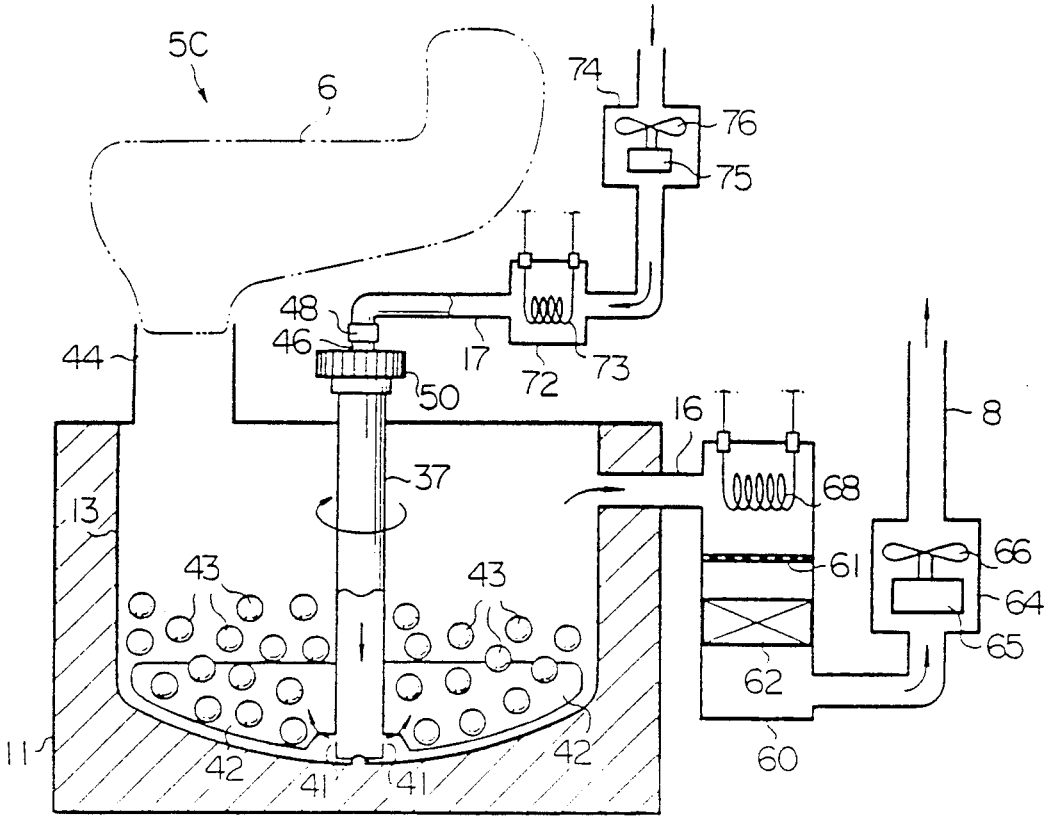
Figure 10 is a view for explaining the connections between the drying apparatus and a blower and a burner according to the fourth embodiment.

Fourth Embodiment (FIGS. 9 to 10)

A raw sewage drying apparatus according to a fifth embodiment of the invention will be described with reference to FIGS. 9 and 10.

The raw sewage drying apparatus 5C, as illustrated in FIG. 10, has the air supply pipe 17 from the blower unit 74 connected to the sleeve 48, and has a heating unit 72 associated therewith between the blower unit 74 and the sleeve 48. The heating unit 72 has a hollow chamber containing an electric heater 73 therein, which chamber communicates with pipe 17.

The duct 16 is connected to the dust collector 60, which collector has therein a re-heating electric heater 68 at the upper portion thereof and the filter 61 at the middle portion thereof and a catalyst 62 made of platinum etc. fixed to the lower portion thereof. The output of collector 60 is connected to the discharging blower unit 64 which connects to the diffusion pipe 8 so that the air and the vapor passes through the unit 64 into the diffusion pipe 8.

In operation, after storage of a predetermined amount of raw sewage in the inner casing 13, the heaters 73 and 68 are energized while motors 55, 75, 65 are rotated. The motor 75 drives the fan 76 so that the air from the outside is introduced into the heating unit 72. The heater 73 in the heating unit 72 heats the air to a temperature of several hundred degrees and the heated air then flows through the blower pipe 17 and is introduced into the drive pipe 37. The air is then blown from the communication holes 41 into the bottom of the inner casing 13. Hence, the hot air as heated by the heater 73 heats the heating balls 43 contained in the inner casing 13 as well as the raw sewages stored in the inner casing 13.

Since the motor 65 in the blower 64 is already actuated, the air in the inner casing 13 flows toward the discharge pipe 8 via the duct 16 and the dust collector 60 having therein the catalyst. The saturated vapor evaporated in the inner casing 13 is drawn into the dust collector 60 via the duct 16 and contacts the reheating heater 68 so that the temperature of the saturated vapor is increased and the minute dust etc. is removed by the filter 61 and contacts the catalyst. Since the saturated vapor is oxidized by the catalyst, the saturated vapor components causing the bad smell such as ammonia, bromine, etc. are oxidized so as to make the air odorless. When the raw sewage is evaporated in the inner casing 13, the components thereof which generate the bad smell are simultaneously evaporated, but the bad smell can be removed at the time when the vapor is reheated in the dust collector 60 and oxidized by the catalyst. The odorless air including the saturated vapor is discharged from the diffusion pipe 8 via the discharging unit 64.

Upon completion of the drying operation of the raw sewage in the inner casing 13, the heaters 73 and 68 are de-energized and the motors 55, 75, 65 are stopped to complete the drying operation. The raw sewage drying apparatus is ready for the next disposal cycle.

With the arrangement of the raw sewage drying apparatus according to the fourth embodiment, the raw sewage can be dried by direct heating of the raw sewage in the inner casing in a manner that the hot air is blown into the raw sewage in the inner casing to thereby heat the whole of the raw sewage uniformly, whereby the thermal efficiency of the raw sewage drying apparatus is improved and the oxidation of the vapor from the raw sewage can be expedited.

Figure 11:
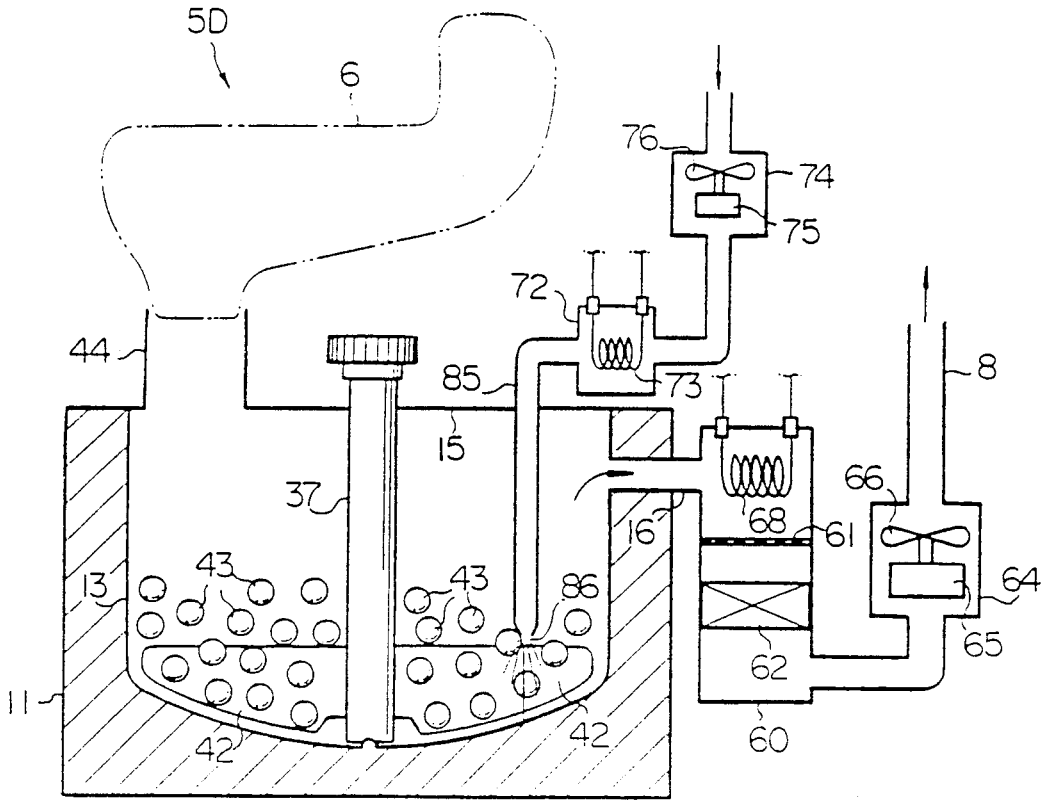
FIG. 11 is a view for explaining the connection between the raw sewage drying apparatus and a peripheral device according to a fifth embodiment of the invention.
Figure 12:
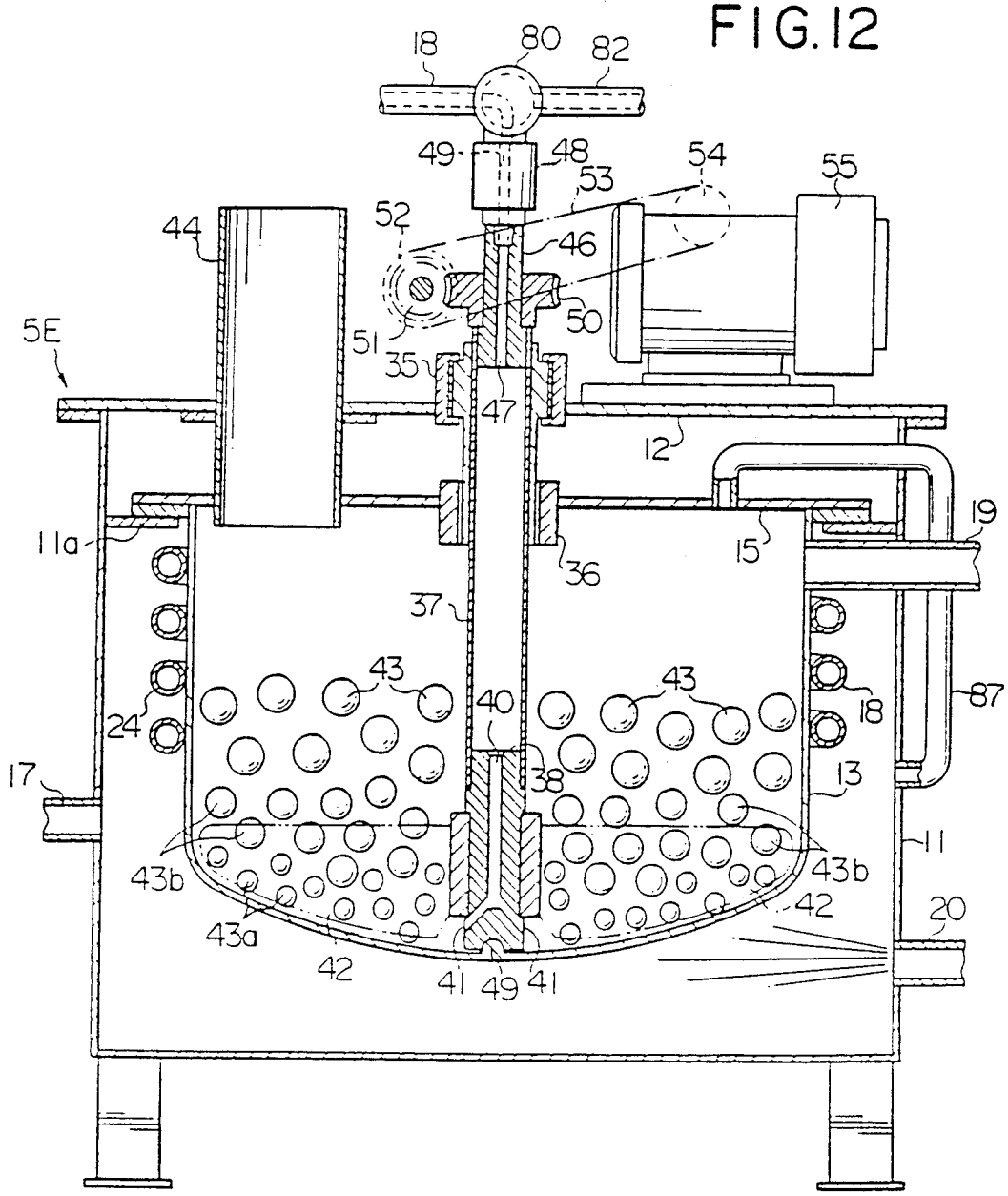
FIG. 12 is a vertical cross sectional view of the raw sewage drying apparatus according to a sixth embodiment of the invention.

Fifth Embodiment (FIG. 11)

A raw sewage drying apparatus 5D according to a fifth embodiment of the invention will be described with reference to FIG. 11.

This embodiment substantially corresponds to the embodiment of FIGS. 9 and 10, except that a hot air pipe 85 is inserted into the inner casing 13 via the inner cover 15 and has a nozzle 86 at the lower tip end thereof positioned adjacent the upper edge of the stirring blades 42. The hot air pipe 85 is connected to the heating unit 72 having the heater 73 therein while the heating unit 72 is connected to the blower unit 74. The air is introduced into the heating unit 72 by the actuation of the fan 76.

In operation, the motors 55, 65, 75 are first actuated and the heaters 73, 68 are energized whereby the air from the outside introduced into the heating unit 72 via the blower 74 passes through the hot air pipe 85 and is jetted from the nozzle 86 toward the bottom of the inner casing 13. During passage through the heating unit 72, the air contacts the heater 73 and is heated thereby to a temperature of several hundred degrees, and the air thus heated is jetted from the nozzle 86. The thus jetted hot air contacts the raw sewage to thereby heat the whole inner surface of the inner casing 13 and simultaneously the heating balls 43. The temperature of the heating balls 43 thus heated by the hot air is increased.

As mentioned above, the drive pipe 37 and the stirring blades 42 are rotated by the motor 55. The raw sewage and the heating balls 43 are simultaneously stirred by the stirring blades 42 so that the temperature of the whole of the raw sewage is increased uniformly. The temperature increase is expedited when the raw sewage contacts the surfaces of the heating balls 43.

Since the motor 65 is actuated, the air in the inner casing 13 is drawn out by the fan 66 whereby the air including the saturated vapor is heated by the reheater 68 and oxidized by the catalyst 62 and the bad smell thereof is removed. As a result, the odorless air is discharged outside.

With the arrangement of the raw sewage drying apparatus according to the fifth embodiment, the same effect as that of the fourth embodiment can be obtained.

Sixth Embodiment (FIGS. 12 to 15)

A raw sewage drying apparatus 5E according to a sixth embodiment of the invention will be described with reference to FIGS. 12 to 15. The structure and function of this sixth embodiment is substantially the same as the above embodiments except for those differences set forth hereunder.

Figures 13, 14:
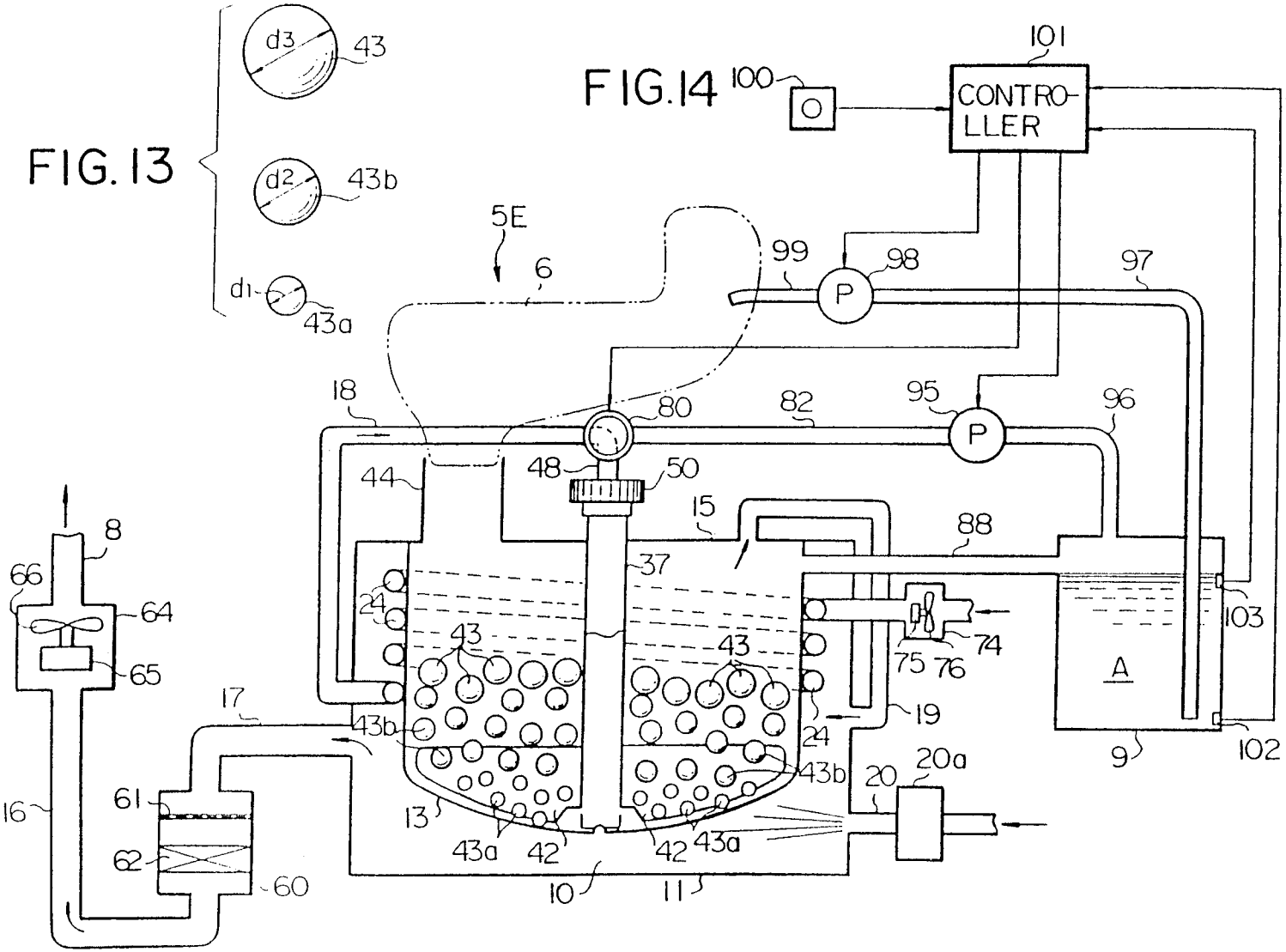
FIG. 13 is a view of the heating balls employed in the sixth and seventh embodiments.
FIG. 14 is a view for explaining the connection between the drying apparatus and a peripheral device according to the sixth embodiment.

The inner casing 13 contains therein a plurality of heating balls of three sizes, namely, small sized balls 43*a* each having a diameter D1, middle sized balls 43*b* each having a diameter D2, and large sized balls 43 each having a diameter D3, as illustrated in FIG. 13. The small sized balls 43*a* are positioned in or laid on the lower portion of the inner casing 13 while the middle sized balls 43*b* and the large sized balls 43 are positioned in or laid on the middle portion and the upper portion respectively of the inner casing 13.

The sleeve 48 has at its upper end a threedirectional selector valve 80. The selector valve 80 is connected at one end thereof to the connection pipe 18 and at the other end thereof to a suction pipe 82 communicating with a water tank 9 so that the vent 49 can connect to the connection pipe 18 or the suction pipe 82 depending on the selection thereof.

The raw sewage drying apparatus 5E is connected as illustrated in FIG. 14. The water tank 9 communicates with the inner casing 13 by an inlet pipe 88. A pump 95 is connected at one end thereof to the inlet pipe 82 and at the other end thereof to one end of a suction pipe 96.

The suction pipe 96 is connected to the upper portion of the water tank 9 and communicates therewith. A liquid discharge pipe 97 is inserted into the water tank 9 and extended to a position adjacent the bottom of the water tank 9, while the other end of pipe 97 is connected to a pump 98. The pump 98 has the discharge side thereof connected to a jetting pipe 99. The jetting pipe 99 is positioned at the location capable of jetting the water toward the inner peripheral side wall of the stool 6. There is provided inside the housing 3 a start button 100 which is actuated by the user of the temporary toilet. A signal issued by the start button 100 is supplied to a controller 101, the output of which is supplied to the three-directional valve 80 and the pumps 95, 98. The liquid level in the water tank 9 is set to be substantially the same as that of the raw sewage in the inner casing 13. Sensors 102, 103 are fixed to the side surface of the water tank 9 for detecting the lower and upper levels of the water in the tank 9, and the output of the sensors are supplied to the controller 101.

The operation of the raw sewage drying apparatus according to this sixth embodiment will now be described.

Preparation for use:

The base 2 is positioned at the place where the temporary toilet 1 is to be installed. A predetermined amount of water A is introduced in the water tank 9 and another amount of water is prepared for reserve. The three-directional selector valve 80 is selected to connect the sleeve 48 to the suction pipe 82.

Use of temporary toilet:

The users enters into the temporary toilet 1 and discharges toward the stool 6. The discharged raw sewage falls via the introduction pipe 44 into the inner casing 13 and is stored therein. The large sized waste material such as feces and toilet paper are laid over the large sized heating balls 43 and kept at a raised position in the inner casing 13 while urine passes through the gaps between the small, middle and large sized heating balls 43*a*, 43*b*, 43 and collects adjacent the bottom of the inner casing 13. The solid materials and the liquid material can be separated by the different sizes of the heating balls 43*a*, 43*b*, 43.

The start button 100 is activated by the user to issue a signal which is supplied to the controller 101. On the basis of the control signal the pump 98 is actuated so that water A in the water tank 9 is drawn up by the pipe 97. The water thus drawn is jetted toward the stool 6 by the discharge pipe 99 and cleans the inner peripheral wall of the stool 6, and is then returned to the inner casing 13 via the introduction pipe 44.

The filth attached to the stool 6 is cleaned each time the start button is pushed by the user so that the stool is kept all the time in a clean and hygienic condition. This is repeated by pushing the start button 100. In the case where the water in tank 9 is lowered by the use of the temporary toilet 1 to some extent, the sensor 102 can detect the water level to issue a signal which is supplied to the controller 101.

On the reception of the signal from the sensor 102, the controller 101 actuates the pump 95. The pump 95 starts to draw the liquid material stored in the bottom of the inner casing 13 so that the liquid material passes through the communication holes 41 into the drive pipe 37, then upwardly through the selector valve 80 into the suction pipe 82, and then is discharged from the suction pipe 96 into the water tank 9. Upon actuation of the drawing operation by the pump 95, the liquid material stored in the inner casing 13 is circulated to fill the water tank 9. In the case where the water A in tank 9 reaches a predetermined maximum level, the detector 103 detects that effect and issues the signal which is supplied to the controller 101. On the reception of the signal the controller 101 stops the operation of the pump 95. With this series of operations, the water is always automatically supplied to the water tank 9 by the circulation of the liquid material in the inner casing 13, which results in preventing the water tank 9 from losing the water A even if the number of uses of the temporary toilet increases. Excess water A in tank 9 is returned to the inner casing 13 through the inlet pipe 88.

Drying operation of the raw sewage:

Although the temporary toilet 1 is utilized by the user in the manner set forth above, when the raw sewage is stored in the inner casing 13 over a predetermined amount, the raw sewage is subjected to a drying operation. Before starting of the drying operation, the controller 101 controls the selector valve 80 to connect the sleeve 48 to the connection pipe 18, and also controls the motors 65, 75 to actuate the fans 66, 76. Then the controller 101 controls the burner 20*a* to actuate it so that hot air is blown from the burner pipe 20 into the space 10 defined between the outer casing 11 and the inner casing 13.

Since the fans 66, 76 are already actuated, the air in the space 10 is always drawn toward the diffusion pipe 8 via the discharge pipe 17, the dust collector 60, and the duct 16. The outside air is introduced into the heat exchanger pipe 24 by the fan 76 and flows toward the sleeve 48 via the connection pipe 18. The air passing through the heat exchanger pipe 24 flows into the drive pipe 37 and passes through the vent 40 and the communication holes 41, and is then jetted from the holes 41 into the bottom of the inner casing 13.

The air pressure in the space 10 is lowered to draw the air through the return pipe 19 by the actuation of the fan 66 so that the air in the inner casing 13 flows into the return pipe 19, and is then discharged outside through the diffusion pipe 8 together with the hot air from the burner 20*a*.

With such series of operations, the air in the space 10 is circulated and flows thereinto. Since the air combusted and heated by the burner 20*a* is blown into the space 10, the thus heated hot air heats the whole lower portion of the inner casing 13 and the heat is at the same time accumulated in the heating balls 43*a*, 43*b*, 43 contained in the inner casing 13. Hence, the raw sewage in the inner casing 13 is heated by the whole heating of the inner casing 13 and the heating balls 43*a*, 43*b*, 43 so that the liquid component of the raw sewage starts to evaporate.

Simultaneously, the motor 55 is actuated to horizontally rotate the drive pipe 37, thereby allowing the stirring blades 42 to rotate horizontally adjacently the bottom of the inner casing 13 whereby the raw sewage and the heating balls 43*a*, 43*b*, 43 are stirred at the same time.

The raw sewage is mixed while stirred so as to become of uniform temperature. Heat emitted from the surfaces of the heating balls 43*a*, 43*b*, 43 is transmitted to the raw sewage to expedite the increase of temperature of the whole raw sewage.

Since the air from the outside is circulated within the heat exchanger 24 by the operation of the blower 74, the same air is heated by the heat from the burner pipe 20 to form the hot air. The hot air is transmitted to the connection pipe 18, then flows into the drive pipe 37 and is thereafter jetted from the communication holes 41 toward the bottom of the inner casing 13.

Inasmuch as the jetted air is already heated by the heat exchanger pipe 24, the same air contacts the raw sewage at a high temperature to help the drying operation and expedite the speed of evaporation of the liquid component.

With such series of operations, the raw sewage is heated by the heat of the whole inner casing 13 and the heat of the hot air jetted therein whereby the liquid component thereof is evaporated. The vapor thus evaporated in the inner casing 13 is drawn by the return pipe 19 and introduced into the space 10. Since the vapor evaporated from the raw sewage in the inner casing 13 includes therein urea and ammonia, the vapor has a bad smell. However, when the vapor enters into the space 10 where the hot air from the burner 20*a* is jetted, the vapor is re-heated at an extreme high temperature and flows toward the discharge pipe 17.

The air flows through the discharge pipe 17 into the dust collector 60 where the solid material thereof and the dust is first removed by the filter 61, then reaches the catalyst 62. When the re-heated air having a bad smell contacts the catalyst 62, the component constituting the bad smell is oxidized whereby the bad smell is removed. The air having no bad smell is drawn by the fan 60 via the duct 16 and discharged outside by the diffusion pipe 8.

With this series of operations, the raw sewage in the inner casing 13 is heated by the heat of the inner casing 13 which is heated from the outside and by the heat of the hot air heated by the heat exchanger and jetted directly thereto.

Additionally, since the surface areas of the heating balls 43*a*, 43*b*, 43 are large, the heat of the heating balls 43*a*, 43*b*, 43 transmitted to the raw sewage expedites the evaporation thereof.

Upon completion of operation of the burner 20*a* for a predetermined period of time so that the raw sewage is subjected to drying and evaporating operations, the burner 20*a* as well as the motors 65, 75, 55 are stopped, whereby the temporary toilet 1 enters in a waiting state, being ready for the next user.

At the time when the temporary toilet is switched to a waiting state, if the drive shaft 37 is stopped, the heating balls 43*a*, 43*b*, 43 automatically tend to separate vertically depending on the size thereof whereby the small sized heating balls 43*a* are laid on the bottom of the inner casing 13 while the large sized heating balls collect in the upper portion of the inner casing 13. Thereafter the controller 101 controls the three-directional selector valve 80 so that the valve 80 is switched to the opposite direction for preparation of the clearing of the stool by washing thereof.

With the arrangement of the raw sewage drying apparatus according to this sixth embodiment, it is possible to install the temporary toilet at a place where no water supply or sewerage systems are available, and the temporary toilet can be kept clean at all times since the stool is washed by the water similar to the flush toilet in the ordinary house.

Figure 16:
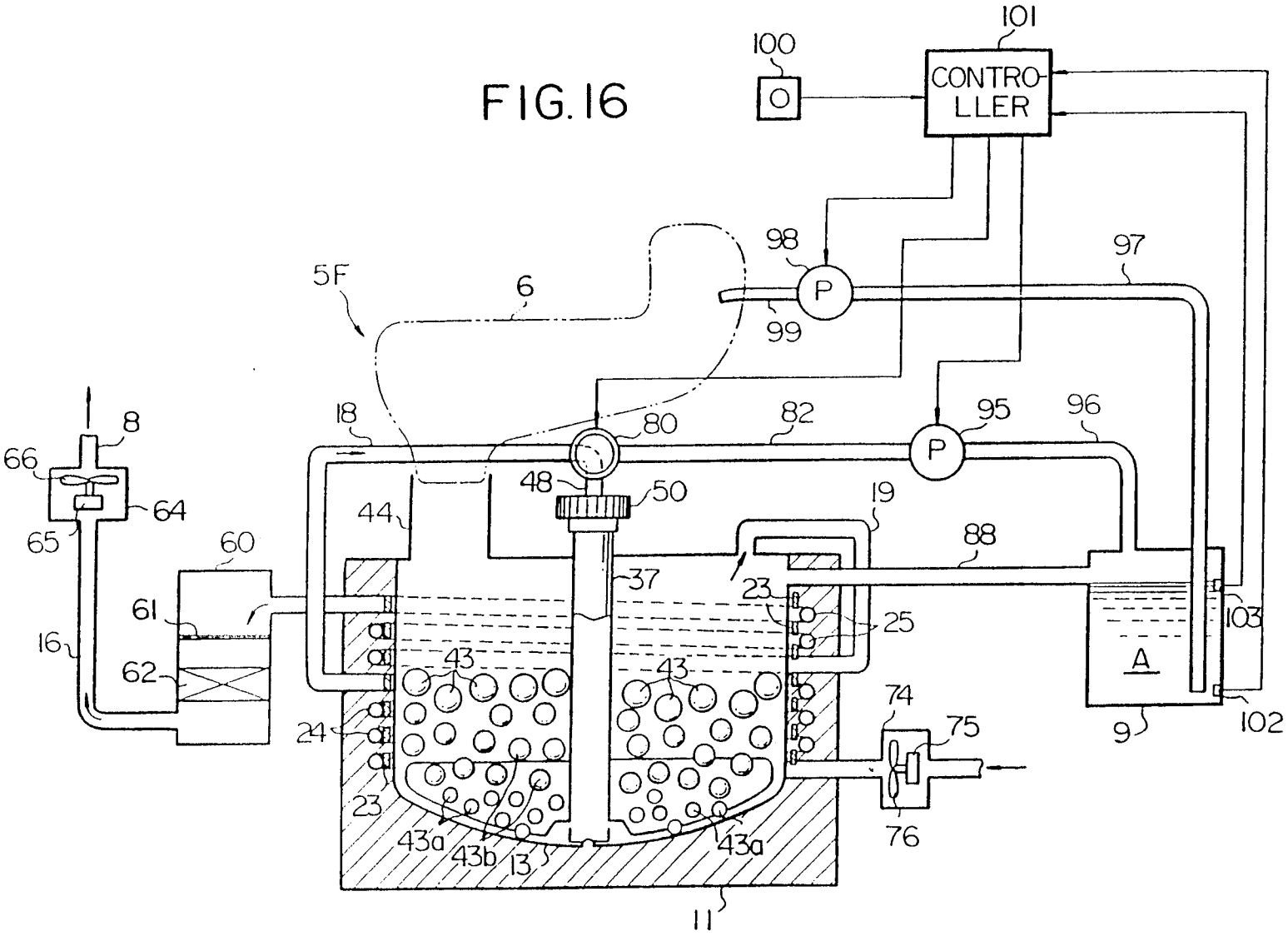
FIG. 16 is a view for explaining the connection between the drying apparatus and a peripheral device according to the seventh embodiment of the invention.

Seventh Embodiment (FIG. 16)

A raw sewage drying apparatus 5F of the seventh embodiment will be described with reference to FIG. 16 which shows the connection between the raw sewage drying apparatus and the peripheral devices such as pipes.

The raw sewage drying apparatus 5F according to the seventh embodiment does not employ the burner or heater as employed in the third and fifth to seventh embodiments, but employs an electric heater for heating and drying the raw sewage. In fact, this FIG. 16 embodiment employs a dryer arrangement which substantially corresponds to the dryer of FIG. 6, when coupled with the exterior water tank arrangement The inner casing 13 has at its outer periphery an electric heater 23 of flat shape wound therearound. The heat exchanger pipe 24 is wound around the lower portion of the heater 23 while the re-heating pipe 25 is wound around the upper portion of the heater 23.

The blower 74 is connected to one end of the heat exchanger 24 so that the air from the outside is forcibly delivered inside thereto. The heat exchanger 24 is connected at the other end thereof to the connection pipe 18. The re-heating pipe 25 is connected at one end thereof to the suction pipe 19 communicating with the inside of the inner casing 13 and at the other end thereof to the dust collector 60 having therein the filter 61 and catalyst 62. The space defined between the inner casing 13 and the outer casing 11 is filled with the heat insulating material 21.

At the time of use of the stool 6, the pump 98 is actuated to draw the water from the water tank 9 so that the water is jetted from discharge pipe 99 for cleaning the stool 6. When a predetermined amount of raw sewage is stored in the inner casing 13, the raw sewage is subjected to the drying operation. The controller 101 controls the selector valve 80 so that the selector valve connects the connection pipe 18 to the sleeve 48 while the heater 23 is energized to heat the whole of the inner casing from the outside thereof. The controller 101 controls the motors 55, 75, 65 so that the air from the outside is introduced into the heat exchanger pipe 24, passes therethrough and flows into the drive pipe 37 via the connection pipe 18 and the selector valve 80. The air is then jetted from the communication holes 41 toward the bottom of the inner casing 13. Since the fan 66 is driven, the air in the inner casing 13 is drawn by the suction pipe 19 and passes through the suction pipe 19, re-heating pipe 25, dust collector 60, and is then discharged outside by the diffusion pipe 8.

The air delivered from the outside by the fan 76 is heated during passing through the heat exchanger 24 since the heat exchanger 24 contacts the outer periphery of the energized heater 23. The heated air is jetted toward the bottom of the inner casing 13. Hence, the raw sewage in the inner casing 13 is heated from the heat from the inside of the inner casing 13 and from the outside of the inner casing 13. The drive pipe 37 driven by the motor 55 rotates the stirring blades 42 to thereby stir the heating balls 43*a*, 43*b*, 43 so that the temperature of the raw sewage is uniformly increased to evaporate the liquid material of the raw sewage.

The evaporated liquid is drawn by the suction pipe 19 and re-heated by the heater 23 to a higher temperature during passing through the re-heating pipe 25, and then flows into the dust collector 60. The dust etc. of the air is removed by the filter 61, and the high temperature air contacts the catalyst 62 where the impurities such as bad smell are removed. The air is then discharged outside by the fan 66 so that the vapor from the raw sewage is dispersed to the atmosphere.

With the arrangement of the seventh embodiment, the supply of water inside the water tank and the disposal of the raw sewage is automatically carried out. Hence, the raw sewage drying apparatus of the seventh embodiment can be used at any location where electric power can be supplied and can be used with high safety since no combustion is used.

Although the invention has been described in its preferred forms with a certain degree of particularity, it is to be understood that many variations and changes are possible in the invention without departing from the scope thereof.

The embodiments of the invention in which an exclusive property or privilege is claimed are defined as follows:

1. In a portable toilet having a tank defining therein a chamber for collecting raw sewage, and a stool communicating with said tank for supplying raw sewage thereto, the improvement comprising:

a heating device for heating the raw sewage contained within said tank;

a stirring shaft rotatably supported on said tank and projecting into the interior thereof, said stirring shaft having a plurality of stirring blades thereon within the interior of said tank; and a plurality of heat-transfer balls contained in the interior of said tank.

2. A portable toilet according to claim 1, wherein said stirring shaft projects vertically and centrally of said tank and has an air passage extending axially thereof and terminating in a communication hole which communicates with the interior of said tank, and external conduit means connected to the passage in said stirring shaft and extending exteriorly of said tank.

3. A portable toilet according to claim 2, including an exterior blower system for removing vapor and solid material in the form of dust from the interior of said tank.

* * * * *